US006220471B1

(12) United States Patent
Lowry

(10) Patent No.: US 6,220,471 B1
(45) Date of Patent: Apr. 24, 2001

(54) RESEALING OVERCAP FOR A CYLINDRICAL CONTAINER

(75) Inventor: James W. Lowry, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/440,383

(22) Filed: Nov. 15, 1999

(51) Int. Cl.[7] ..... B65D 41/62
(52) U.S. Cl. ..... 220/258; 220/780; 220/359.1
(58) Field of Search ..... 220/258, 276, 220/256, 780, 781, 789–791, 359.1, 359.2, 359.4, 254

(56) References Cited

U.S. PATENT DOCUMENTS

| | | | | |
|---|---|---|---|---|
| 2,829,794 | | 4/1958 | Epps . | |
| 2,908,417 | | 10/1959 | Conner et al. . | |
| 3,401,819 | | 9/1968 | Salamone . | |
| 3,624,789 | * | 11/1971 | Peyser | 220/258 |
| 4,453,646 | * | 6/1984 | Harrild | 220/258 |
| 4,856,674 | * | 8/1989 | Berney | 220/258 |
| 4,856,708 | * | 8/1989 | Giasi | 220/359.2 |
| 4,993,577 | * | 2/1991 | Griffin et al. | 220/258 |
| 5,353,943 | * | 10/1994 | Hayward | 220/258 X |
| 5,415,306 | | 5/1995 | Luch et al. . | |
| 5,775,531 | | 7/1998 | Lowry . | |

* cited by examiner

*Primary Examiner*—Nathan J. Newhouse
(74) *Attorney, Agent, or Firm*—Alston & Bird LLP

(57) ABSTRACT

A resealing overcap is provided for fitting over a top end of a cylindrical container and an easy-open top end closure thereon which includes an end ring having an inside circular downwardly and inwardly curved bead defining a central opening and closed by a removable membrane positioned thereon. The resealing overcap includes a circular central portion having an outer periphery and adapted to extend radially of the container when positioned thereon for covering the top end closure. The overcap further includes a downwardly depending flange integrally extending from and around the central portion outer peripheral area and adapted to extend axially of the cylindrical container when positioned thereon to provide a friction fit around the end ring of the container end closure when positioned thereon. The resealing overcap further includes a downwardly depending flexible ring portion integrally extending from an inside surface of the overcap central portion and adapted to extend axially of the cylindrical container when positioned thereon to define a leading edge portion adapted to be positioned over the inside circular bead of the container end closure when positioned thereon before opening of the container and adapted to flex and snap fit around the bead of the end ring of the container end closure upon opening of the container and removal of the easy-open membrane patch for resealing of the container.

7 Claims, 1 Drawing Sheet

RESEALING OVERCAP FOR A CYLINDRICAL CONTAINER

FIELD OF THE INVENTION

This invention relates to an improved construction of an overcap for fitting over a top end of a cylindrical container and an easy-open top end closure thereon which includes an end ring defining a central opening closed by a removable membrane.

BACKGROUND OF THE INVENTION

Easy-open containers have heretofore been provided for a variety of products including powdered products, such as food products, cleaning products, etc. These easy-open containers are often constructed of a composite cylindrical body portion having end closures for closing and sealing the container and wherein the top end closure comprises an end ring seamed to the composite container body and having an inside circular peripheral area in the form of a downwardly and inwardly curved bead and defining a central opening of desired size to have access therethrough to the interior of the container. The top end closure further includes an easy-open membrane patch of sufficient size to cover the central opening and attached to the end ring for allowing detachment and removal when it is desired to open the container to obtain access to the product therein.

These types of easy-open containers often also include overcaps constructed for fitting over the container top end portion and top end closure before and after opening of the container. These overcaps serve many functions including, but not limited to, protecting the top of the container from damage before and after removal of the membrane and opening of the container, keeping unwanted items from getting into the container after removal of the membrane and opening of the container, keeping the product within the container from spilling out of the container after opening of the container, helping improve stack-ability of these containers before and after opening, and increasing the life of the product after opening of the container.

With the increased packaging of moisture and oxygen sensitive products into these types of containers, the need has been established for an improved re-seal feature for the container, after opening of the container and removal of the membrane, to re-seal the container and prevent undesirable moisture and oxygen from entering the container.

OBJECT AND SUMMARY OF THE INVENTION

Accordingly, it is the object of this invention to provide a generally circular overcap adapted to fit over a top end of a cylindrical container and top end closure thereon which includes an end ring having an inside circular downwardly and inwardly curved bead defining a central opening and closed by a removable membrane positioned thereon, wherein the overcap construction includes a resealing feature for resealing of the container after initial opening thereof and removal of the membrane from the top end closure.

It has been found by this invention that this object may be accomplished by providing a resealing overcap comprising a circular central portion having an outer periphery and adapted to extend radially of the container when positioned thereon for covering the container top end portion. The overcap further includes a downwardly depending flange portion integrally extending from and around the central portion outer peripheral area and adapted to extend axially of the cylindrical container when positioned thereon and having an inside diameter approximately equal to the outside diameter of the cylindrical container to provide a friction fit around the end ring of the container when positioned thereon.

The overcap further includes a downwardly depending flexible ring portion integrally extending from an inside surface of the overcap central portion and adapted to extend axially of the cylindrical container when positioned thereon to define a leading edge portion adapted to be positioned over the inside circular bead of the container end closure when positioned thereon before opening of the container and adapted to flex and snap fit around the downwardly and inwardly curved bead of the end ring of the container end closure upon opening of the container and removal of the easy-open membrane patch for resealing of the container. It has been found preferable to have the leading edge of the flexible ring of the overcap of a diameter smaller than the central opening of the container top end closure and to extend outwardly of the overcap at a predetermined angle of between 30° and 45° to the overcap downwardly depending flexible ring. It has also been found preferable to construct the overcap as an injection molded plastic overcap.

BRIEF DESCRIPTION OF THE DRAWINGS

An object and advantages of this invention have been set forth above, other objects and advantages of the invention will become apparent in the detailed description of a preferred embodiment of this invention to be described below, when taken in conjunction with the accompanying drawings, in which.

DETAILED DESCRIPTION OF PREFERRED EMBODIMENT OF THE INVENTION

Figure 1:
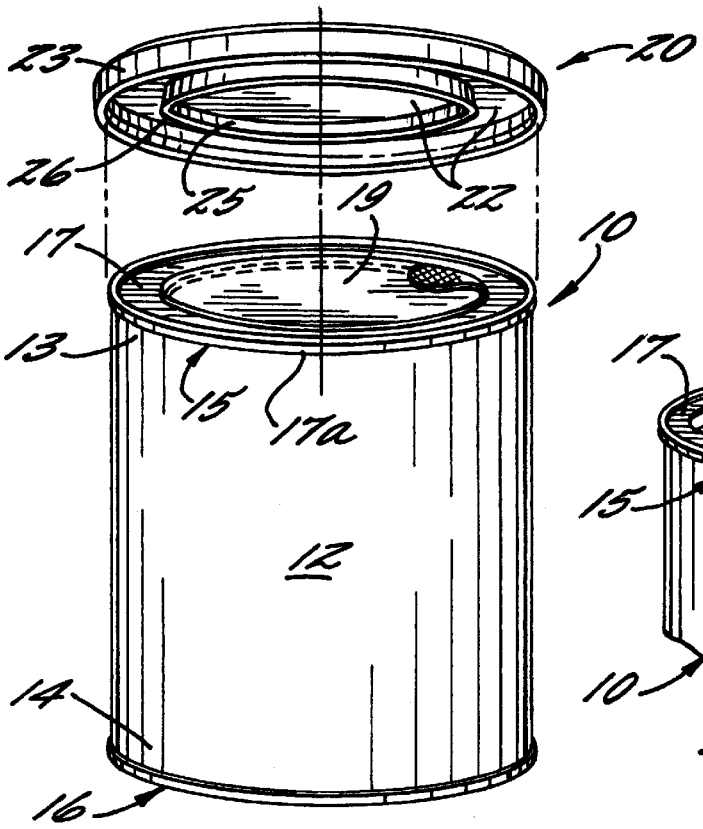
FIG. 1 is a perspective view of an easy-open container having the improved overcap of this invention thereon and showing the overcap in exploded position.

Referring now to the drawings, there is shown in FIG. 1 an easy-open container, generally indicated at 10, which is adapted for being filled with a powdered product P, such as food products, cleaning products, etc. The container 10 may be of any desired configuration and may be constructed of any desired material including composites, plastic, metal, etc. However, it is preferred that the container 10 be of a generally cylindrical configuration and be constructed of composite materials including paper layers of the type normally utilized for constructing containers for powdered products P and which are well understood by those with ordinary skill in the art.

The container 10 comprises a generally cylindrical container body 12 defining top and bottom opposite end portions 13, 14. The container 10 further includes top and bottom end closures 15, 16 attached respectively to the top and bottom container body end portions 13, 14 for closing and sealing the container with product P therein in a manner well understood by those with ordinary skill in the art. The bottom end closure may be any suitable end closure attached to or seamed to the bottom end portion 14 of the container and may be constructed of metal, composites, plastic or other suitable material.

Figure 2:
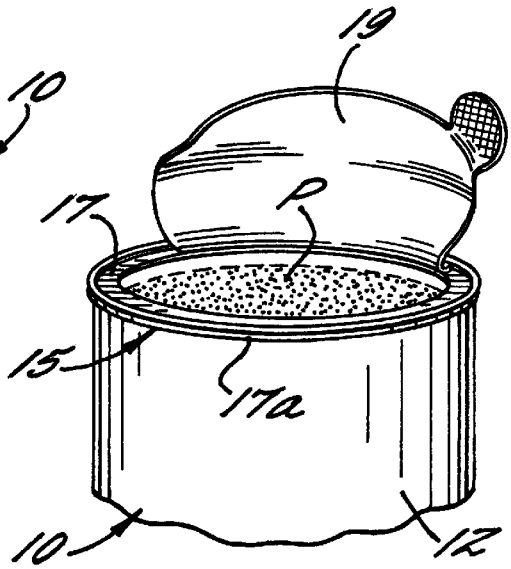
FIG. 2 is a perspective view of the top portion of the container of FIG. 1 with the top end closure thereon and illustrating the membrane of such top end closure being removed for opening of the container to obtain access to the product therein.
Figure 3:
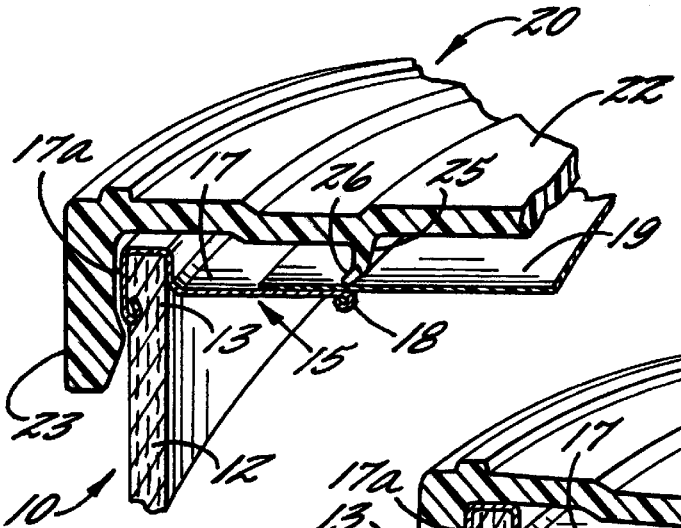
FIG. 3 is a sectional view of one-side of the top portion of the container of FIG. 1, before removal of the membrane of the top end closure, and with the overcap in position thereon.
Figure 4:
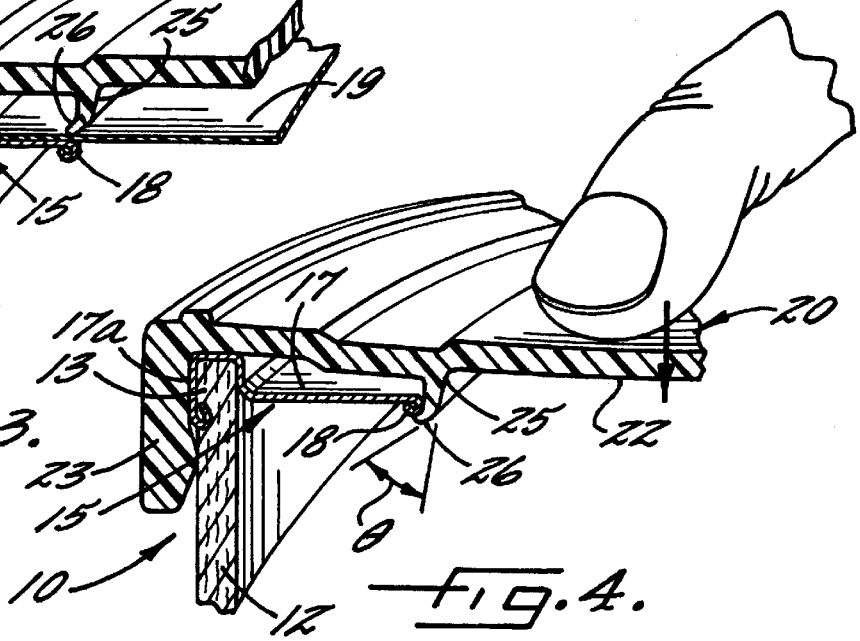
FIG. 4 is a view, like FIG. 3, after the membrane has been removed from the top end closure and the overcap repositioned on the end of the container and snap-fitted into the opening in the end closure formed by removal of the membrane for resealing of the container.

The top end closure 15 is of an easy-open type which comprises an end ring 17 having an outside circular peripheral area 17*a* seamed to the container body top end portion 13 (as shown particularly in FIGS. 3 and 4). The end ring 17 further includes an inside circular peripheral area in the form of a downwardly and inwardly curved bead 18 which defines a central opening of desired size to allow access therethrough to the interior of the container 10 (as shown particularly in FIG. 2). The top end closure 15 further includes an easy-open membrane patch 19 of sufficient size to cover the central opening and which is attached to the end ring 17 for allowing detachment and removal of the membrane patch 19 (as shown in FIG. 2) when it is desired to open the container 10 to obtain access to the product P therein.

The end ring 17 of the top end closure 15 may be constructed of any suitable material including composites, metal, plastic, etc. and the membrane patch may be constructed of any suitable material including composites, metal, plastic, etc. The bond or attachment between the membrane patch 19 and the end ring 17 may be any suitable bond including heat seal, adhesive etc. to create a bond of sufficient strength to resist internal forces within the container, while being sufficiently weak in the tensile direction to allow sealing of the bond for easy-opening of the top end closure 15 of the container 10, in a manner well understood by those with ordinary skill in the art. Preferably the bond may be formed with a polypropylene heat seal layer on the membrane patch or the end ring or both.

In accordance with this invention, a resealing overcap 20 is constructed for fitting over the container body top end portion 13 and the top end closure 15 before and after opening of the container 10 (as shown particularly in FIGS. 3 and 4) and for snap fitting into the central opening of the top end closure 15 after opening of the container 10 and removal of the easy-open membrane patch 19 for resealing of the container (as shown in FIG. 4).

The overcap 20 comprises a circular central portion 22 having an outer periphery and extending radially of the container 10 for covering the container top end portion 15. The overcap 20 further includes a downwardly depending flange portion 23 which integrally extends from and around the outer peripheral area of the central portion 22 and axially of the container body 12 when positioned on the container 10. This flange portion 23 has an inside diameter approximately equal to an outside diameter of the container body 12 to provide a friction fit around the end ring 17 and the outside peripheral area 17*a* thereof which is seamed to the top container body end portion 13 (as shown in FIGS. 3 and 4).

The resealing overcap 20 further includes a downwardly depending flexible ring portion 25 integrally extending from an inside surface of the overcap central portion 22 and axially of the container body 12 when positioned on the container 10 to define a leading edge portion 26. This leading edge portion 26 is positioned over the inside peripheral area or bead 18 of the top end closure end ring 17 before opening of the container 10 (as shown in FIG. 3) and is adapted to flex and snap fit around the downwardly and inwardly curved bead 18 on the inside peripheral area of the top end closure 15 upon opening of the container 10 and removal of the easy-open membrane patch 19 (as shown in FIG. 4). This may be accomplished (as shown in FIG. 4) by exerting pressure with a finger or the like on the middle portion of the central portion 22 of the resealing overcap 20 which causes the leading edge portion 26 of the downwardly depending flexible ring portion 25 to flex and snap fit around the bead 18 on the inside of the end ring 17 of the end closure 15 of the container 10.

As may be seen in FIGS. 3 and 4, the leading edge portion 26 of the downwardly depending ring 25 of the resealing overcap 20 is preferably of a diameter larger than a diameter of the inside peripheral area defined by the bead 26 of the end ring 17 of the top end closure 15 of the container 10 and extends outwardly of the overcap 20 at a predetermined angle θ to the downwardly depending ring 25 thereof so as to effect the flexing and snap-fitting around the downwardly and inwardly curved bead 26 of the end closure 15 of the container 10 when re-sealing is desired. It is preferable that the predetermined angle θ of the leading edge portion 26 to the downwardly depending ring 25 of the resealing overcap 20 is between 30° and 45°. The resealing overcap may be constructed of any suitable material having the characteristics described above and preferably is constructed of plastic and is injection molded so as to provide the downwardly depending flexible ring 25 which allows flexure and snap fitting around the bead 18 of the end ring 17 of the top end closure 15 of the container 10.

Thus, the present invention has provided an improved resealing overcap for use on a container having an easy-opened top end closure and which is constructed to provide for resealing of the container after the top end closure has been opened to gain access to the product within the container.

In the drawings and specification, there has been set forth a preferred embodiment of this invention and, although specific terms are employed, these terms are used in a generic and descriptive sense only and not for purposes of limitation. The scope of the invention is set forth in the following claims.

What is claimed is:

1. In a container comprising a generally cylindrical container body defining top and bottom opposite end portions, top and bottom end closures attached respectively to said top and bottom container body end portions for closing and sealing the container with product therein, wherein said top end closure is of the easy-open type and comprises an end ring having an outside circular peripheral area seamed to said container body top end portion and having an inside circular peripheral area in the form of a downwardly and inwardly curved bead for defining a central opening of desired size to allow access therethrough to the interior of said container, and wherein said top end closure further comprises an easy-open membrane patch of sufficient size to cover said central opening and which is attached to said end ring for allowing detachment and removal when it is desired to open said container to obtain access to the product therein; the improvement of:

a resealing overcap constructed for fitting over said container body top end portion and said top end closure before and after opening of said container and for snap fitting into said central opening of said top end closure after opening of said container and removal of said easy-open membrane patch for resealing of said container; said overcap comprising a circular central portion having an outer periphery and extending radially of said container in generally the same plane for covering said container top end portion, a downwardly depending circular flange portion integrally extending from and around said central portion outer peripheral area and axially of said container body and having an inside diameter approximately equal to an outside diameter of said container body to provide a friction fit around said end ring seamed to said container body top end portion, and a downwardly depending flexible ring portion integrally extending from an inside surface of said overcap central portion concentrically with said circular flange portion and axially of said container body to define a leading edge portion positioned over said inside peripheral area of said top end closure end ring before opening of said container and adapted to flex and snap fit around said downwardly and inwardly curved bead forming said inside peripheral area of said top end closure upon opening of said container and removal of said easy-open membrane patch and while said flange portion is positioned around said container end ring.

2. In a container, as set forth in claim 1, in which said leading edge portion of said downwardly depending flexible ring of said resealing overcap is of a diameter larger than a diameter of said inside peripheral area of said container top end closure end ring and extends outwardly of said overcap at a predetermined angle to said overcap downwardly depending flexible ring.

3. In a container, as set forth in claim 2, in which said predetermined angle of said leading edge portion to said downwardly depending flexible ring of said overcap is between 30° and 45°.

4. In a container, as set forth in claim 1, 2 or 3, in which said overcap comprises an injection molded plastic overcap.

5. A resealing overcap adapted to fit over a top end of a cylindrical container and an easy-open top end closure thereon which includes an end ring having an inside circular downwardly and inwardly curved bead defining a central opening which is closed by a removable membrane positioned thereon; said overcap comprising:

a circular central portion having an outer periphery and adapted to extend radially of the container in generally the same plane when positioned thereon for covering the container top end closure;

a downwardly depending circular flange portion integrally extending from and around said central portion outer peripheral area and adapted to extend axially of the cylindrical container when positioned thereon and having an inside diameter approximately equal to an outside diameter of the cylindrical container to provide a friction fit around the container top end closure when positioned thereon; and a downwardly depending flexible ring portion integrally extending from an inside surface of said overcap central portion concentrically with said circular flange portion and adapted to extend axially of the cylindrical container when positioned thereon to define a leading edge portion adapted to be positioned over the inside circular bead of the container end closure when positioned thereon before opening of the container and adapted to flex and snap fit around the downwardly and inwardly curved bead of the end ring of the container end closure upon opening of the container and removal of the easy-open membrane patch and while said flange portion is positioned around said container end ring for resealing of the container.

6. A resealing overcap, as set forth in claim 5, in which said leading edge portion of said flexible ring of said overcap is of a diameter larger than the central opening of the container top end closure and extends outwardly of said overcap at a predetermined angle of between 30° and 45° to said overcap downwardly depending flexible ring.

7. A resealing overcap, as set forth in claim 5 or 6, in which said overcap comprises an injection molded plastic overcap.

* * * * *